United States Patent [19]

Weldon et al.

[11] 4,390,155

[45] Jun. 28, 1983

[54] GARBAGE CAN AND LID HOLDER

[76] Inventors: Howard Weldon, Sanford Rd., West Springfield, Pa. 16443; James Stoker, 11763 Ridge Rd., East Springfield, Pa. 16411

[21] Appl. No.: 207,137

[22] Filed: Nov. 17, 1980

[51] Int. Cl.[3] ..... A47B 97/00

[52] U.S. Cl. ..... 248/507; 248/DIG. 7

[58] Field of Search ..... 248/507, 508, 147, 154, 248/DIG. 7

[56] References Cited

U.S. PATENT DOCUMENTS

| | | | |
|---|---|---|---|
| 2,471,257 | 5/1949 | Blank | 248/DIG. 7 |
| 2,505,126 | 4/1950 | Logan | 248/DIG. 7 |
| 2,690,823 | 10/1954 | Mokhiber | 248/DIG. 7 |
| 3,235,213 | 2/1966 | Hall | 248/DIG. 7 |
| 3,561,710 | 2/1971 | Cummings | 248/147 |
| 3,822,845 | 7/1974 | Kennedy et al. | 248/DIG. 7 |

*Primary Examiner*—Ramon S. Britts
*Assistant Examiner*—Michael F. Trettel
*Attorney, Agent, or Firm*—Charles L. Lovercheck; Wayne L. Lovercheck; Dale R. Lovercheck

[57] ABSTRACT

A garbage can and lid holder made up of a ground inserted post and a weight telescopically received on the port and a lever swingably mounted on the weight approximately at the lever's midpoint. Can lid engaging members are attached to the lever adjacent each end to rest on the lid of the garbage can. One garbage can can be located on each side of the post.

1 Claim, 4 Drawing Figures

GARBAGE CAN AND LID HOLDER

GENERAL STATEMENT OF INVENTION

It is difficult to maintain trash cans in a neat condition. Wind blows the lids about and animals upset the cans. The following invention provides a means for holding the lids in place on two trash or garbage cans for holding the trash can in position and provides a neat way of preventing the cans from being blown about by the wind.

REFERENCE TO PRIOR ART

The following prior art shows various types of garbage can lid holders. However, none of them show a lid holder that has the advantages of applicant's lid holder.

| | | |
|---|---|---|
| 1,131,774 | 2,636,639 | 3,065,858 |
| 1,505,086 | 2,808,173 | 3,935,964 |
| 2,513,630 | 3,028,015 | 3,997,072 |

OBJECTS OF INVENTION

It is an object of the invention to provide an improved garbage can lid holder.

Another object of the invention is to provide the garbage can lid holder that is simple in construction, economical to manufacture and simple and efficient to use.

Another object of the invention is to provide an improved container lid holder.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF DRAWING

DETAILED DESCRIPTIONS OF THE DRAWINGS

Figure 1:
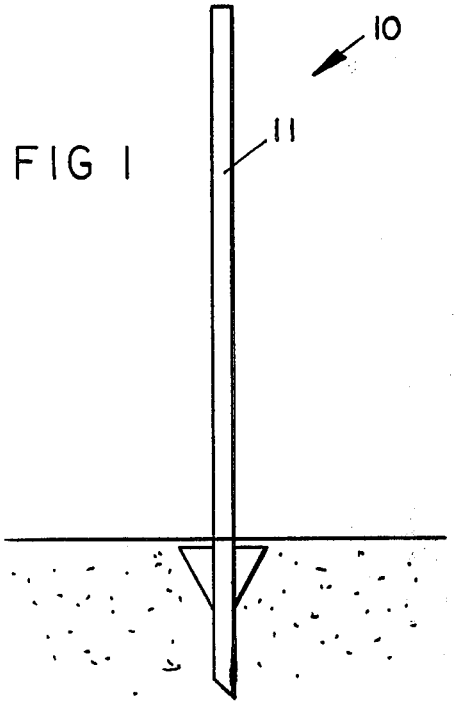
FIG. 1 is a view of the post supported in the ground for supporting the garbage can holder.
Figure 2:
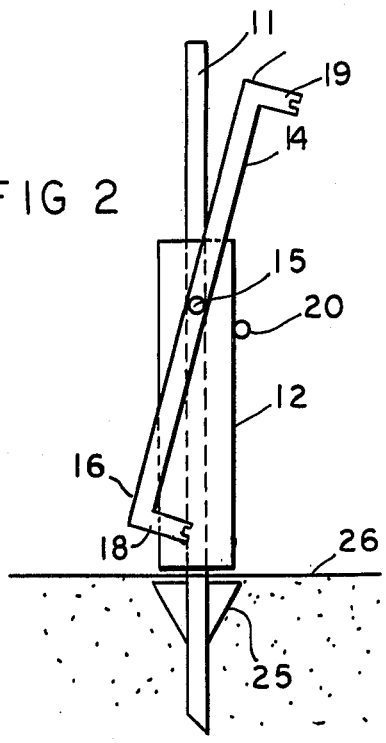
FIG. 2 is a view of the lid holder shown in folded position without a garbage can.
Figure 3:
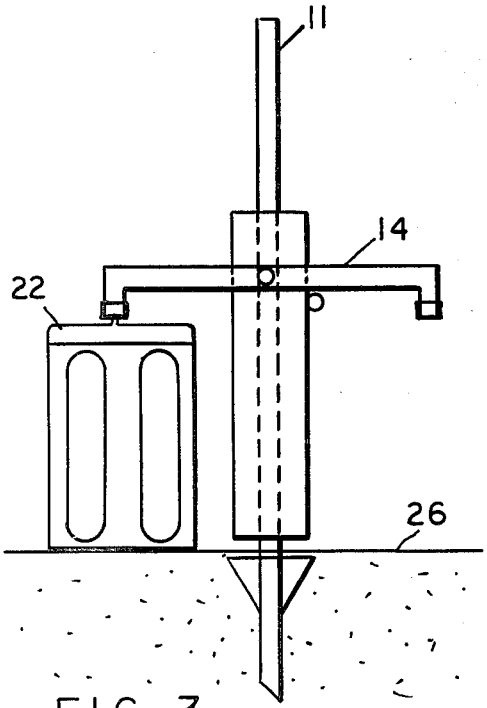
FIG. 3 is a view of a lid holder showing the holder holding one can in place.
Figure 4:
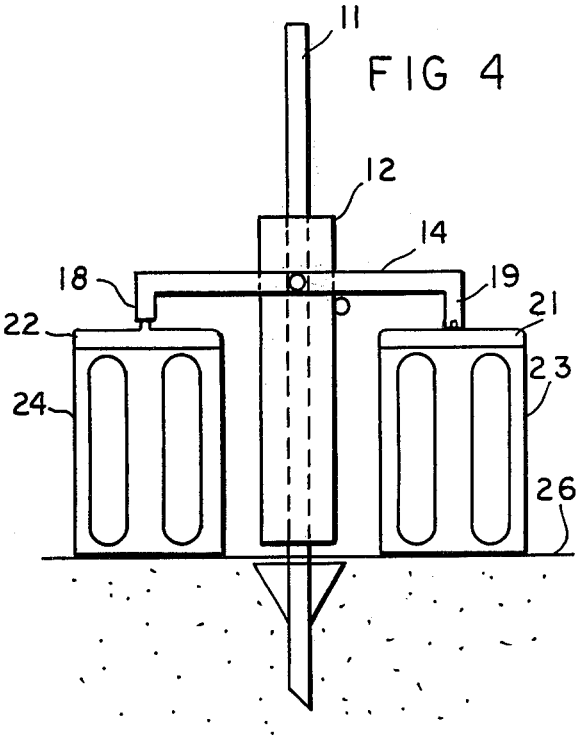
FIG. 4 shows a view of the lid holder holding two container lids in place.

Now with more particular reference to the drawing, I show a post 11 in connection with the can and lid holder. A weight is telescopically received on the post 11 and the lever 14 is swingably mounted at 15 on the lid holder. A lid engaging means 18 is supported on the first end 16 of the lever 14 and a second lid engaging means is supported on a second end 19 of the lid holder. A stop 20 engages the can holder limiting its movement. To use the can holder the operator will lift the weight 12 so that the lid engaging means 18 and 19 of a type familiar are in the form of rubber cups or "crutch tips" to those skilled in the art are moved up away from the lids 21 and 22 of the cans 23 and 24. The cans 23 and 24 will then be put in place and the lid holder weight 12 lifted and rotated 90° so that the lid engaging means 18 and 19 rest on the can lids 21 and 22. Where there are no cans, the lever 14 can be swung to a position generally parallel to the port as shown in FIG. 2. The post 11 has a gusset 25 that maintains its position in the ground, with the ground level being indicated at 26. Weight 12 has a handle fixed to it for lifting weight 12.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A can holder for a container comprising:

a post adapted to be inserted into the ground, a weight slidably supported on the post for vertical movement thereon, a pivot means on said weight, a lever having a first end and a second end and an intermediate part, said pivot means engaging said intermediate part, and means on the first end to engage the lid of a first garbage can and means on said second end for engaging the lid of a second garbage can whereby said pivot means slidably supports said lever on said weight, and a stop (20) attached to the weight to engage the lever at a position spaced from the pivot (15).

* * * * *